United States Patent [19]

McCoubrey

[11] Patent Number: 4,458,569

[45] Date of Patent: Jul. 10, 1984

[54] SAW ASSEMBLY AND WORK TABLE THEREFOR

[76] Inventor: Samuel McCoubrey, "Newgrove", 72 Dunmore Rd., Ballynahinch, County Down, Northern Ireland

[21] Appl. No.: 239,490

[22] Filed: Mar. 2, 1981

[30] Foreign Application Priority Data

Mar. 1, 1980 [GB] United Kingdom ..... 8007045

[51] Int. Cl.[3] ..... B27B 17/02

[52] U.S. Cl. ..... 83/366; 83/370; 83/544; 83/547; 83/DIG. 1

[58] Field of Search ..... 83/574, 425, 437, 544, 83/63, 360, 366, 370, 372

[56] References Cited

U.S. PATENT DOCUMENTS

| | | | |
|---|---|---|---|
| 1,861,162 | 5/1932 | Quist | 83/574 X |
| 2,779,359 | 1/1957 | Koski | 83/574 X |
| 4,123,957 | 11/1978 | Niemela et al. | 83/574 X |
| 4,320,679 | 3/1982 | Trudeau | 83/574 |

*Primary Examiner*—Donald R. Schran
*Attorney, Agent, or Firm*—Gerald J. Ferguson, Jr.; Joseph J. Baker

[57] ABSTRACT

A work table for use with a chain saw comprises a flat-topped work surface having a slot defined therein through part of which an elongate member of a pivotal carrier unit extends uprightly and is movable longitudinally therein. The member has in vertical spaced relation to extend from the same side thereof, parallel to and above and below the remaining part of the slot respectively a chain saw guard and a chain saw mounting bracket. The outer end of a stationary link arrangement is to engage around the throttle of a chain saw. With a chain saw fitted with its cutter bar extending upwards through the slot parallel to the member and clamped in mounting bracket, the throttle ready to be engaged and chain saw energized, movement of a workpiece to be cut against the chain saw will move the pivotal unit with the chain saw about its pivot to cause the throttle to be depressed to activate the blade of the cutter bar.

10 Claims, 3 Drawing Figures

SAW ASSEMBLY AND WORK TABLE THEREFOR

This invention relates to saws and particularly to a work-table or bench to which a chain saw can be fitted and used in the same manner as a circular saw.

Chain saws are widely used and renowned for their capability for cutting timber however their use has been limited to felling and cross-cutting trees. It has not been considered practical or possible heretofore to adapt chain saws for use in bench-type sawing consequently chain saws have been used heretofore to fell and cross-cut timber, but ripping of the timber had to be done by circular saw thus it has hitherto been necessary to employ two saws for this purpose.

It is the object of the present invention to provide a work table to which a chain saw can be fitted thus enabling the chain saw to be usable for ripping timber.

According to one aspect of the present invention there is provided for use with a chain saw a work table comprising a flat top supported by a surface-engaging means above a surface, the flat top serving as a work surface and having a slot defined therein through part of which an elongate member of a saw carrier unit extends uprightly, said carrier unit including a chain saw guard and a chain saw mounting bracket, in vertical spaced relation on the member to extend from the same side thereof parallel to, and above and below the remaining part of the slot respectively and clamping means on the chain saw support bracket to clamp a cutter bar of a chain saw in position.

Preferably, the guard and bracket are adapted to locate the chain saw in front of the carrier member of the carrier unit relative to the direction of cut, and is a riving knife.

Preferably also, means are associated with the work table to open the throttle of the chain saw said means being actuated by pressure of a workpiece.

Preferably also, the carrier unit is pivoted in the slot and is biassed by the weight of the chain saw towards the direction of cut whereby pressure of the workpiece against the saw chain will tilt the upper end of the carrier unit towards the other end of the table.

Preferably further, the means for adjusting the throttle of the chain saw comprises a stationary link arrangement, the outer end of which is to engage around the throttle button on the chain saw.

According to a second aspect of the present invention, there is provided a saw assembly comprising a work table as described in the next preceding paragraphs having a chain saw fitted thereto in the manner indicated.

An embodiment of the present invention will now be described by way of example, with reference to the accompanying drawings, in which.

Figure 1:
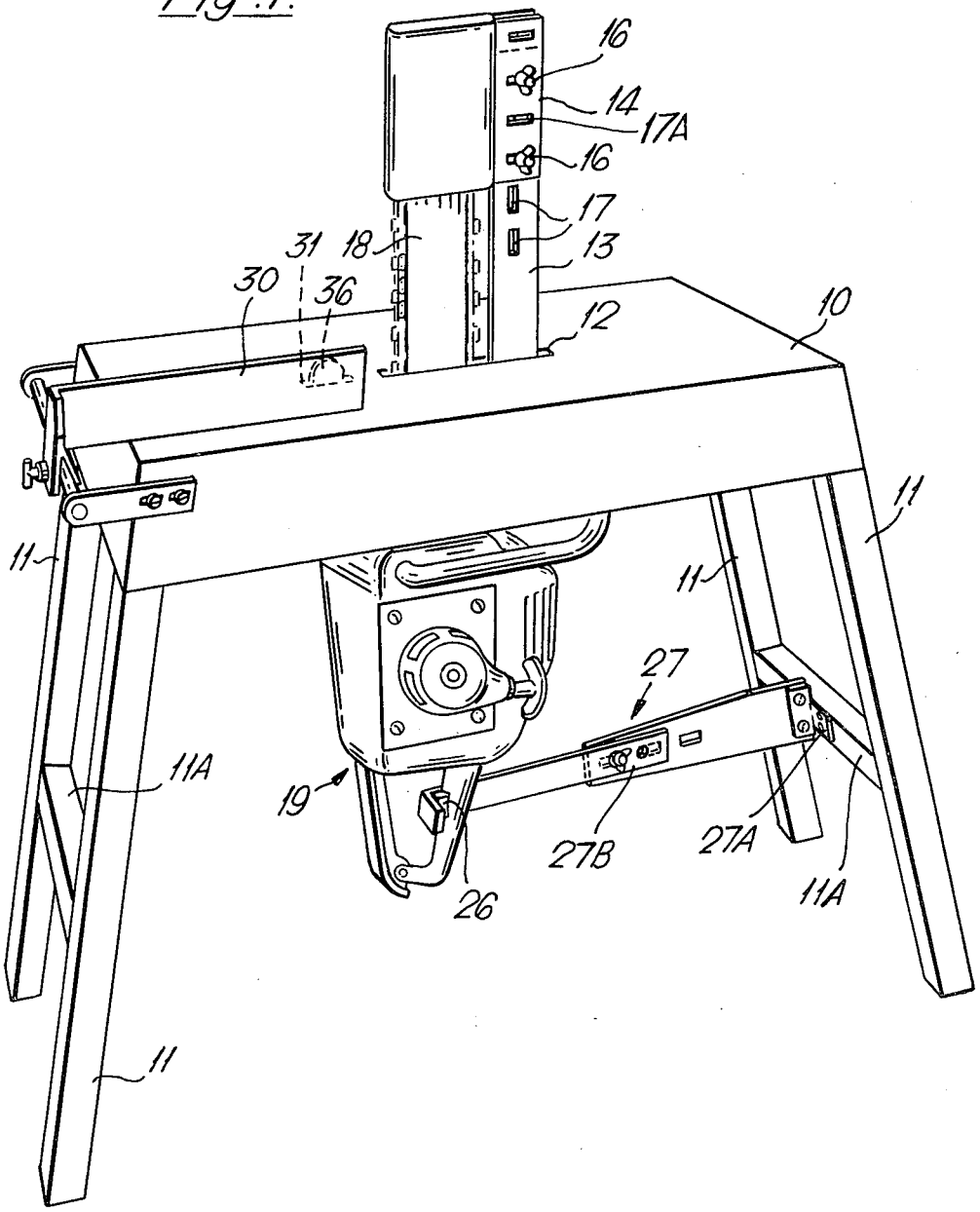
FIG. 1 is a diagrammatic perspective view of a saw according to the present invention.
Figure 2:
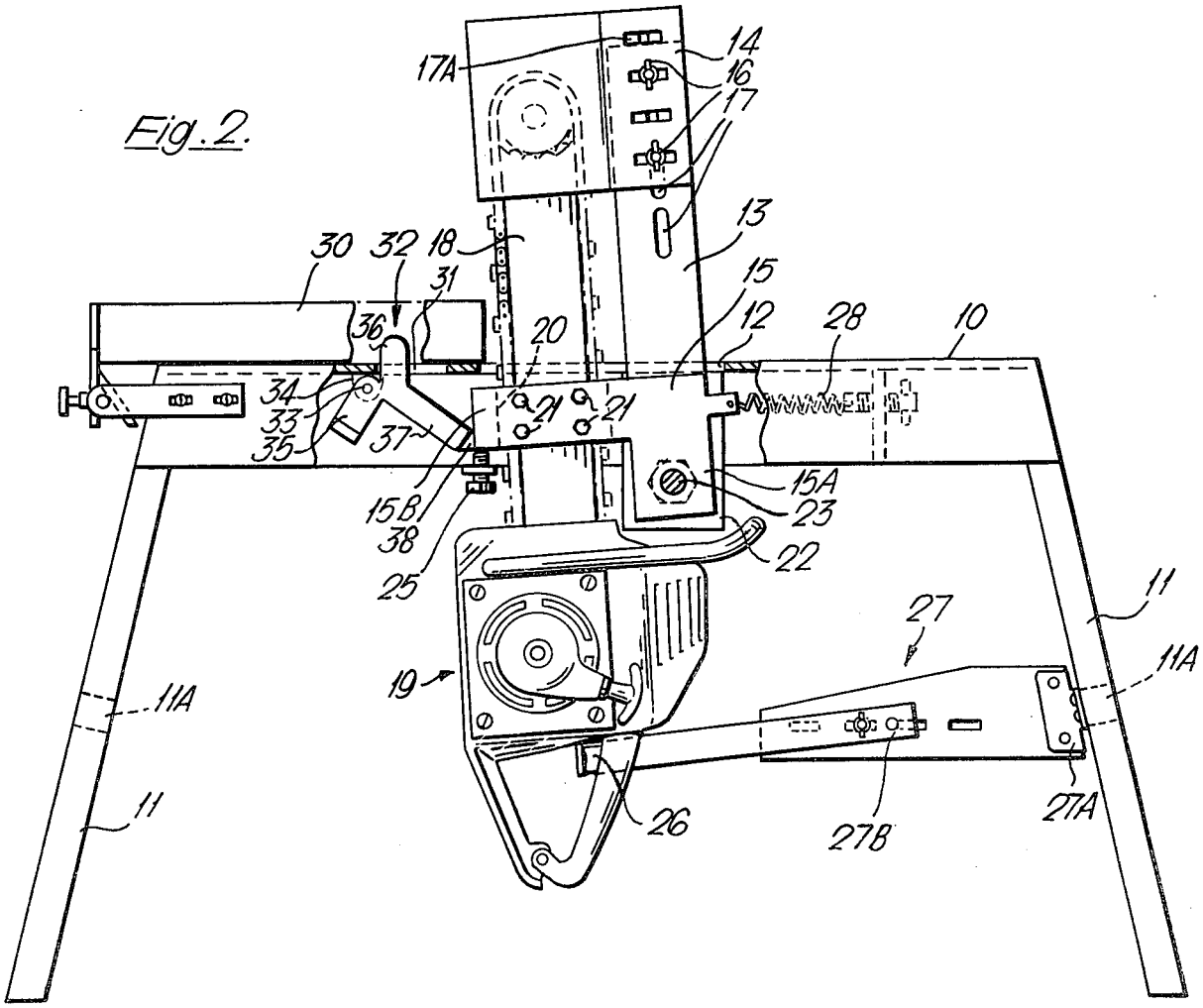
FIG. 2 is a side elevational view of the saw.
Figure 3:
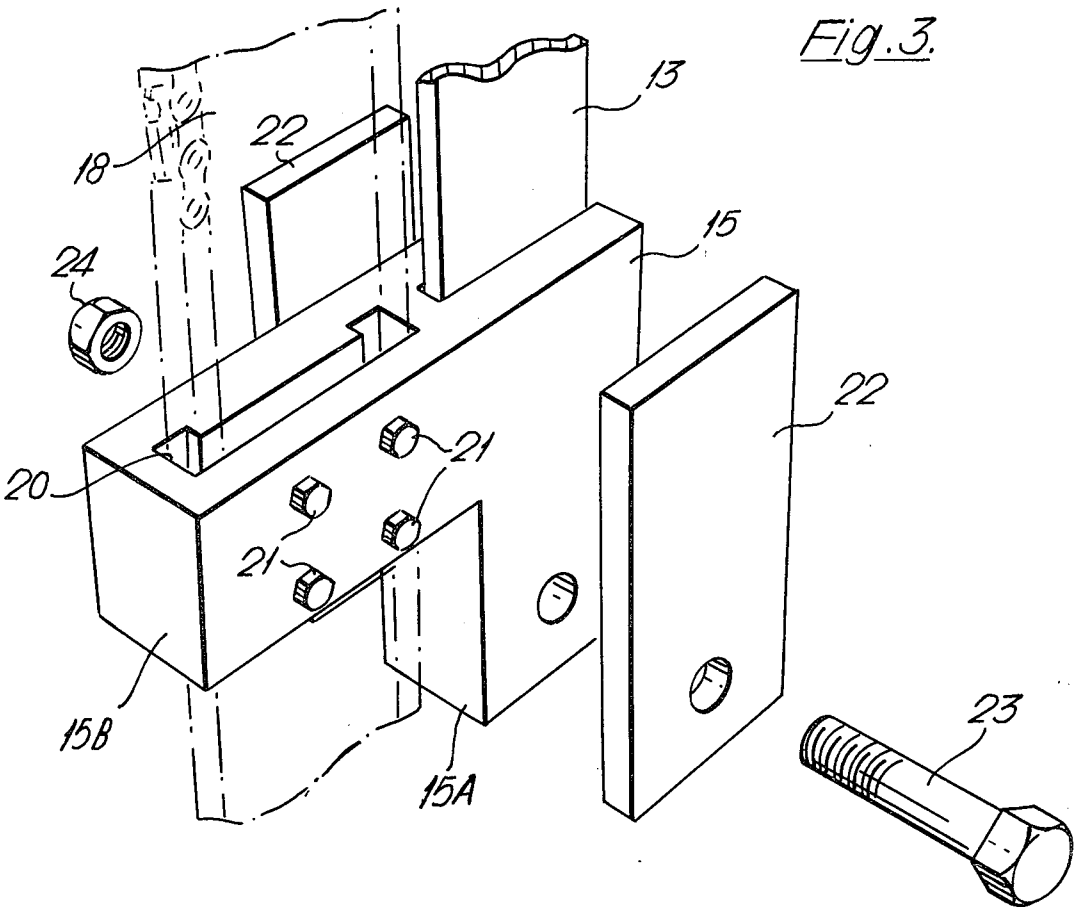
FIG. 3 is an exploded perspective view of a detail of the saw.

Referring to the drawings, a saw comprises a work table and a chain saw. The work table has a rectangular flat top 10 supported above the ground or a surface by ground-engaging means in the form of four legs 11, one at each corner and arranged in pairs, one pair at each end of the table and the legs of each pair being united together by brace 11A: the top 10 serves as a work-surface and a slot 12 is provided midway of the length and breadth of the top 10 and parallel to the longitudinal sides thereof. A carrier unit comprises an elongate member 13 extending uprightly through the slot 12 at one end thereof for longitudinal movement therein, and having in vertical spaced relation thereon to extend from the same side thereof parallel to and above and below the other end of the slot 12 respectively, a saw guard 14 and a saw mounting bracket 15. The carrier unit is pivotally mounted for restricted acruate movement in the slot 12, the pivot being located in the bracket 15. The saw guard 14 is clampably mountable at different heights on the member 13 by the use of bolts engaged by wing nuts 16, alignable vertically spaced holes 17, 17A being provided in the member 13 and guard 14 respectively for this purpose. The part of the guard 14 above the other end of the slot 12 is recessed to accommodate the outer end of the cutter bar 18 of a chain saw 19. The saw mounting bracket 15 is angular in side elevation and mounted on the member 13 with one arm 15A extending downwardly and in alignment with the member 13 and the other arm 15B at right angles thereto to underlie the other end of the slot said other arm having a slot 20 whose axis is parallel to the axis of the downwardly extending arm 15A to accomodate with mechanical clearance a cutter bar 18 therethrough, and in one side of the other arm flanking the slot 20 four retaining bolts 21 are in threaded engagement with four tapped holes, the bolts being tightenable for the outer ends of their shanks to clamp against a cutter bar 18 located in the slot 20. The pivot is mounted between two cheek plates 22 depending from the top 10 on two opposed sides at one end of the slot 12 and is a bolt 23 engaged at its outer end by nut 24. The bottom of the outer end of the other arm 15B abuts the top of a height-adjustable stop 25 to limit the amount of arcuate movement about the pivot, the end wall of the slot 12 limiting the movement in the other direction. A spring tensioner 28 is provided connected to the bracket 15 below the top 10 and at said end wall of the slot. The means for adjusting the throttle 26 of the chain saw 19 comprises a stationary link arrangement 27 as shown in FIGS. 1 and 2 whose outer end engages around the throttle as shown. The arrangement 27 comprises a bracket 27A and a link 27B, the bracket 27A is secured to brace 11A and link 27B is in two parts securable relative to each other to make the link 27B length-adjustable.

A safety device is provided on the other side of the cutter bar 18 from the riving knife 13 and moves in a slot 31 aligned with slot 12. The device is a three armed plate 32 (as shown in FIG. 2) which is pivoted at 33 between two cheeks 34; one arm 35 is weighted to bias arm 36 up through slot 31, and arm 37 functions as a safety-catch such that in its biassed position, the end face of the arm 37 abuts a lug 38 provided extending from the bottom corner of arm 15B.

A conventional chain saw 19 is fitted to the pivotal unit of the work table with the cutter bar 18 extending uprightly through the other end of the slot 12 parallel to the elongate member 13 and in alignment therewith. The outer end of the cutter bar 18 is located in the recess of the guard 14 and the bolts 21 are tightened against the cutter bar 18. The outer end of the link 27B is fitted around the throttle 26. The weight of the chain saw makes the pivotal unit pivot such that the bracket 15 abuts the stop 25 against the biasing of the tensioner 28. In this position of the pivotal unit, the arm 37 of the safety device abuts lug 38 with arm 36 biassed to an upright position as shown through slot 31 until arm 36 is pushed downwardly, the chain saw 19 cannot be operated to cut wood. The portion of the chain saw to be used for cutting is on that side of the cutter bar 18 remote from the elongate member 13 and between the guard 14 and work surface 10. The direction of movement of that portion of the chain is downwardly towards the slot 12. The member 13 is a riving knife whose width is equal to the width of the cutter bar 18. A guide 30 can be provided for guiding the timber to the cutting part of the chain saw.

To commence a cutting operation, the engine of the chain saw 19 is started and remains at idling speed with the chain stationary. A piece of timber is fed towards the chain saw first pushing down arm 36 to release arm 15B and then as it engages, causes the chain saw 19 and pivotal unit to be pivoted backwardly against the weight biasing of the chain saw 19. In so doing, the throttle 26 is depressed by moving against the end of the link 27B. This causes a centrifugal clutch in the chain saw to operate to drive the chain of the cutter bar 18 and the timber is cut as it is being fed to the chain saw. So long as timber is being pushed towards the cutter bar 18, the throttle is fully open, however as soon as the pressure is relaxed, the saw and pivotal unit pivot under the weight of the chain saw towards the stop 25 thereby releasing the throttle 26 so that the chain saw reverts to idling speed. Also the arm 36 moves back to its biassed rest position with the outer end of arm 37 abutting under arm 15B. When the pivotal unit pivots to its rest position, the arm 37 is pivoted against its biasing until being clear of lug 38, it moves to its biased position abutting lug 38.

The above-described saw is advantageous for safety reasons than circular saws since the cutting part of the blade is moving downwardly, and the non-cutting part of the blade is masked by the guard and member. Also, with the chain of the chain saw not being driven unless timber is being cut, makes the above-described saw much safer than the circular saw. Also the start-stop cutting operation eases fuel consumption and engine wear since the engine of the chain saw cannot over rev. The automatic start-stop method of cutting enables an operator to handle long timber some distance away from the saw. The safety device prevents the throttle to drive the blade being accidentally depressed.

In a simplified version of the saw assembly, the carrier unit is not pivotal and the throttle of the chain saw is controlled by any suitable means, such as a pull cord held by the operator or a third party. Alternatively, the throttle may be controlled by a device which is actuated by pressure from the workpiece as it is advanced towards the saw chain, for example an adaption of the safety device.

I claim:

1. For use with a chain saw, a work table comprising a flat top supported by surface-engaging means above a surface, the flat top serving as a work surface, a slot defined therein, a saw carrier unit including an elongate member which extends uprightly through part of the slot, said carrier unit including a chain saw guard and a chain saw mounting bracket in vertical spaced relation on the member to extend from the same side thereof parallel to and above and below the remaining part of the slot respectively, and clamping means on the chain saw support bracket to clamp a cutter bar of a chain saw in position.

2. A work table according to claim 1, wherein the guard and bracket are adapted to locate the chain saw in front of the carrier member of the carrier unit relative to the direction of cut, and said carrier member is a riving knife.

3. A work table according to claim 1 or 2, wherein means associated with the work table is provided to open the throttle of the chain saw, said means being actuated by pressure of a workpiece.

4. A work table according to claim 1, wherein the carrier unit is pivoted in the slot and is biassed by the weight of the chain saw towards the direction of cut whereby pressure of the workpiece against the saw chain will tilt the upper end of the carrier unit towards the other end of the table.

5. A work table according to claim 3, wherein the means to open the throttle is a stationary link which engages the throttle so that tilting of the carrier unit on engagement of the workpiece moves the carrier unit relative to the link and opens the throttle.

6. A work table according to claim 5, wherein said link is adjustable so that the relative movement between the tilted carrier unit and the link is alterable.

7. A work table according to claim 4, wherein a limit stop acts against the bias of carrier unit.

8. A work table according to claim 1, wherein a safety device is provided on the other side of the slot from the member, the device preventing pivotal movement of the chain saw mounting bracket.

9. A work table according to claim 8, wherein the chain saw mounting bracket has a lug and the safety device comprises a plate pivoted under the table top and having at least two arms the plate being biased for one arm to extend up through a second slot in said top and the second arm to abut said lug, movement of said one arm into said slot against the biasing moving the second arm out of abutment and releasing the chain mounting bracket for pivotal movement.

10. A saw assembly comprising the combination of a work table as claimed in any one of claims 1 or 2 and having a chain saw fitted thereto.

* * * * *